US005762518A

United States Patent [19]

Tanigawa et al.

[11] Patent Number: 5,762,518

[45] Date of Patent: Jun. 9, 1998

[54] LEVER MODULAR JACK TELEPHONE TYPE CONNECTOR

[75] Inventors: Yoshihiro Tanigawa, Kyoto; Koji Yamashita, Yokohama; Shinji Morino, Moriguchi; Hirohisa Okuno, Tokyo; Takao Sase, Yokohama; Koji Ikeda, Kyoto; Masahiko Amano, Osaka, all of Japan

[73] Assignee: Matsushita Electric Works, Ltd., Osaka, Japan

[21] Appl. No.: 623,799

[22] Filed: Mar. 29, 1996

[30] Foreign Application Priority Data

Mar. 31, 1995 [JP] Japan ..... 7-076953
Feb. 23, 1996 [JP] Japan ..... 8-036950

[51] Int. Cl.[6] ..... H01R 23/02

[52] U.S. Cl. ..... 439/409; 439/417; 439/676

[58] Field of Search ..... 439/676, 409, 439/417, 418

[56] References Cited

U.S. PATENT DOCUMENTS

| | | | |
|---|---|---|---|
| 4,538,874 | 9/1985 | Dambach et al. . | |
| 4,657,330 | 4/1987 | Levy . | |
| 4,975,078 | 12/1990 | Stroede et al. | 439/405 |
| 5,118,310 | 6/1992 | Stroede et al. | 439/676 |
| 5,297,199 | 3/1994 | Graham et al. | 379/399 |
| 5,358,430 | 10/1994 | Bonvallat et al. | 439/676 |
| 5,368,501 | 11/1994 | Asbell | 439/418 |

FOREIGN PATENT DOCUMENTS

| | | |
|---|---|---|
| 0 310 832 B1 | 4/1989 | European Pat. Off. . |
| 24 49 329 | 7/1975 | Germany . |
| 1 458 637 | 12/1976 | United Kingdom . |

*Primary Examiner*—Gary F. Paumen
*Attorney, Agent, or Firm*—Armstrong, Westerman, Hattori, McLeland & Naughton

[57] ABSTRACT

A modular jack telephone type connector has a housing which is associated with a carrier on which metal conductors are mounted on a top surface of the carrier, a wire positioning fixture which has wire openings for inserting electrical wires and a cavity for receiving terminals of the conductors and is supported in a hole on the top carrier surface allowing the fixture to move vertically in the hole with respect to the carrier, vertical fins which are mounted on the carrier mates vertical grooves which are provided on an opposite side of the wire openings of the fixture for additional secure positioning, a lever which is pivoted at the housing, rotating toward or away from the carrier, and coupled to the fixture via an interlock mechanism in order to transmit a rotational lever motion to the vertical fixture motion. As the lever rotates toward the carrier and pushes the fixture downward, wires inserted into the fixture meets precisely terminals through the cavity of the fixture for insulation displacement electrical contacts without using special termination tools.

13 Claims, 8 Drawing Sheets

70b
50
50
10
100
40
20
11b
70
72
73
71
70a
72

134
132
135
134
133
103
132
135
131
131a
131
131a
142
142
104
143
144
L8
L7
105a
105
141
144
143
L1
L2
101
110a
123
122
112
115
115a
113
113a
123
122
122
110b
114
113
114

LEVER MODULAR JACK TELEPHONE TYPE CONNECTOR

BACKGROUND ART

1. Field of the Invention

The present invention is related to a modular jack telephone type connector employing insulation displacement contacts allowing manual termination of the connector to individual electrical wires of a telephone cable without the use of special termination tools.

2. The Prior Art

Various of modular jack telephone connectors in the field have been proposed. Such telephone connectors make a manual electrical contact without a special tool between an electrical wire and a metal terminal, having a pair of thin pieces at its top, of the connectors by removing insulation cover of the wire by the thin pieces and, subsequently, inserting a conductive core of the wire between the thin pieces.

In particular, U.S. Pat. No. 5,118,310 discloses a modular jack telephone connector which has a housing, a contact carrier that mounts a plurality of metal terminals, and a wire positioning fixture having a plurality of aligned wire guide channels for installation of the wires and a cavity for receiving the terminals. For insulation displacement contacts, electrical wires in the channels are electrically connected with terminals through the cavity by which the fixture moves toward the contact carrier. In this case, it was required to exert a force by hands on the fixture for the contacts.

However, it is desired to provide a modular jack telephone connector with a less exerting force for the insulation displacement contact than the manual force on the prior art modular jack telephone connector for making easier installation of wires.

SUMMARY OF THE INVENTION

A object of the present invention is to provide a modular jack telephone type connector having insulation displacement contacts which is made by using a lever coupled physically with a fixture which is supported in a contact carrier. Thus, the present invention provides the lever-fixture linkage structure to transmit a rotational motion of the lever to a vertical motion of the fixture, resulting in the production of an reduced exerting force with the lever for the insulation displacement contacts by hands.

It is another object of the present invention to provide an interlock mechanism for the lever-fixture linkage structure in order to perform either an engagement or disengagement of the lever to the fixture.

It is another object of the present invention to provide wire openings at a front end of the fixture.

It is another object of the present invention to provide a supporting structure between a back of the fixture and a wall of the carrier for precise lever influenced upward and downward motions of the fixture with respect to the contact carrier. The supporting structure also separates end portions of the wires inserted through the wire openings.

It is another object of the present invention to provide a vertical groove on one side of a fixture and another vertical groove on one side of the fixture which slides between and against vertical tenons supported at the center of the carrier. The structure of the grooves and the tenons provide more precise lever influenced motions.

It is another object of the present invention to provide latches on the fixture in order that the fixture is securely supported in the slide hole which is provided on the carrier.

It is another object of the present invention to provide a hook on the top of the vertical tenons to restrict a closed position of the levers.

It is another object of the present invention to provide a retainer mechanism between the carrier and the levers to secure the lever at a rest position.

It is another object of the present invention to provide two staggered rows of conductive terminals which the first two terminals of these row are used for a fixture and the rest is used for the other fixture. Each of the fixtures has a cavity through which a set of the terminals are inserted.

It is another object of the present invention to provide a recess on the carrier in order to detach electrical wires in the fixture from the terminals manually.

It is another object of the present invention to provide a head on a fixture and a gutter on the lever, which receives the head, to make the lever-fixture coupled motions smooth.

These and other objects, together with the advantages thereof over existing a prior art form, which will become apparent from the following specification or accomplished by means hereinafter described.

DESCRIPTION OF PREFERRED EMBODIMENTS

(EMBODIMENT 1)

Figure 10:
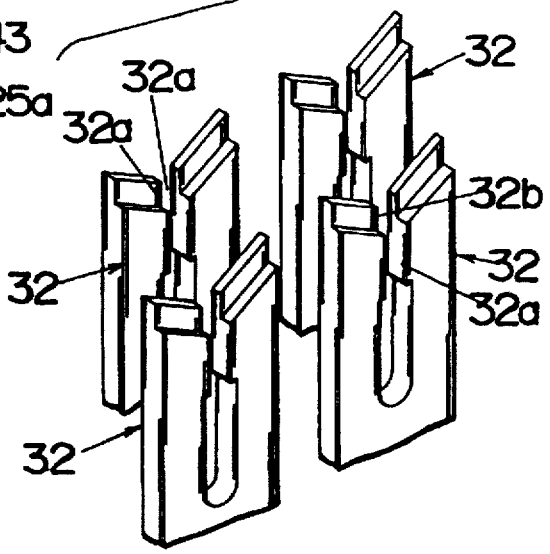
FIG. 10 illustrates a structure of terminals in the first embodiment.

A modular jack telephone connector 100 comprises a body 10 and a carrier 20, a pair of fixtures 40, eight metal conductors 30, a pair of levers 50. The modular jack telephone connector 100 has the fixture 40 capable of holding and sorting electrical wire 2 via separators 41, and the lever 50 capable of transmitting a rotational force toward the carrier 20 to a vertical movement toward the carrier 20 of the fixture 40 for press-fitting the wires 2 in the fixtures 40 between slicers 32*b* in a terminal slit 32*a* of the terminals 32 as shown in FIG. 10.

Since two fixtures 40 are made from a transparent synthetic resin, alignment and contact conditions of end portions of the wires 2 in the fixtures 40 can be seen from outside.

Figure 1:
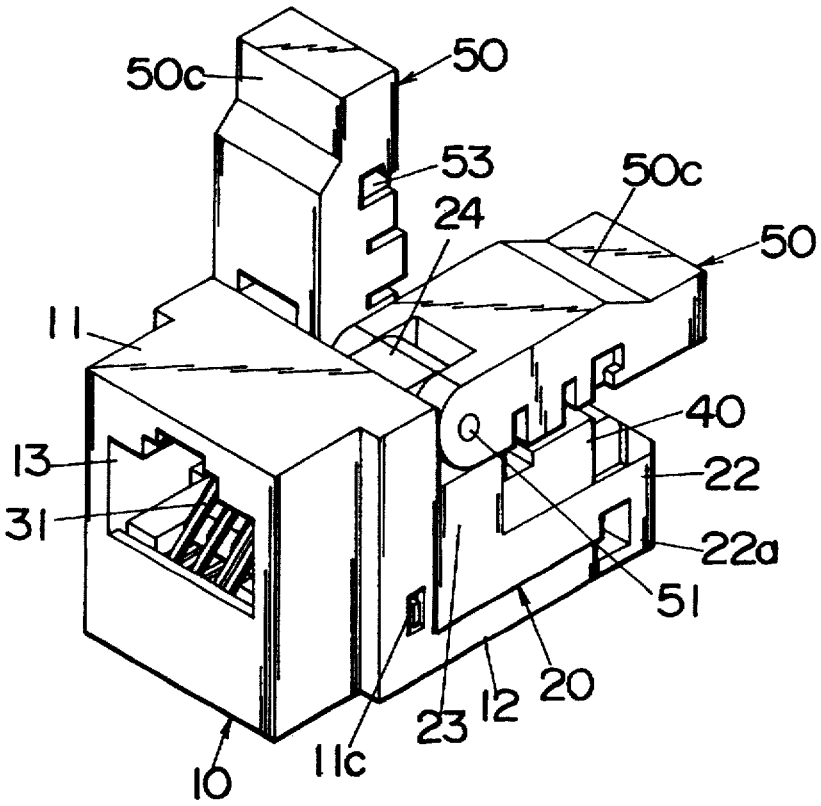
FIG. 1 illustrates a perspective front view of a first embodiment of the modular jack telephone connector.
Figure 2:
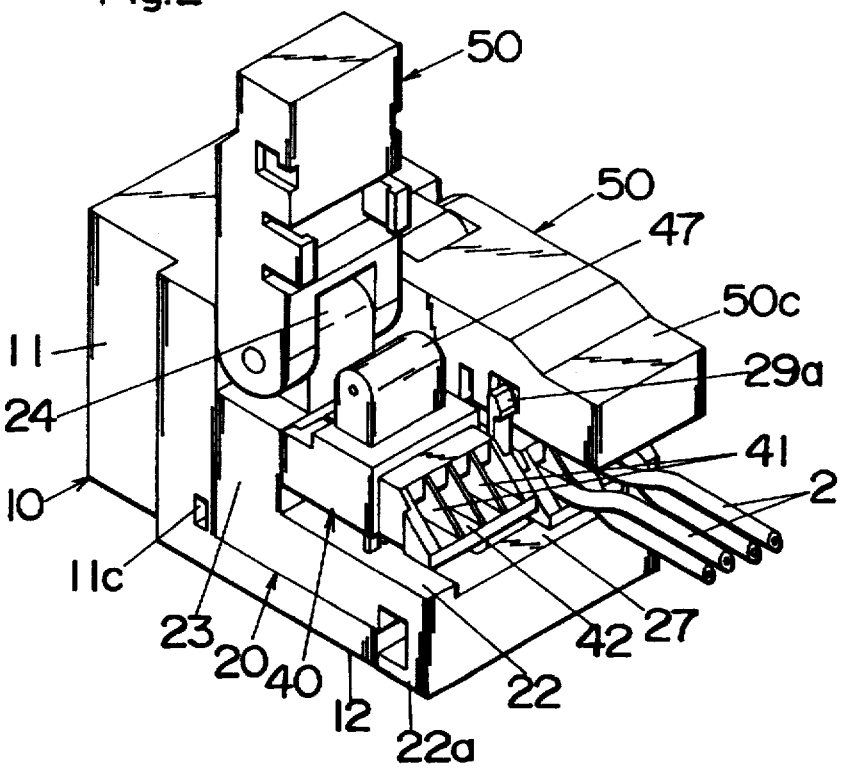
FIG. 2 illustrates a perspective back view of the first embodiment of the modular jack telephone connector.

FIG. 1 and FIG. 2 show a front view and a back view of the modular jack telephone connector 100, respectively.

Figure 3:
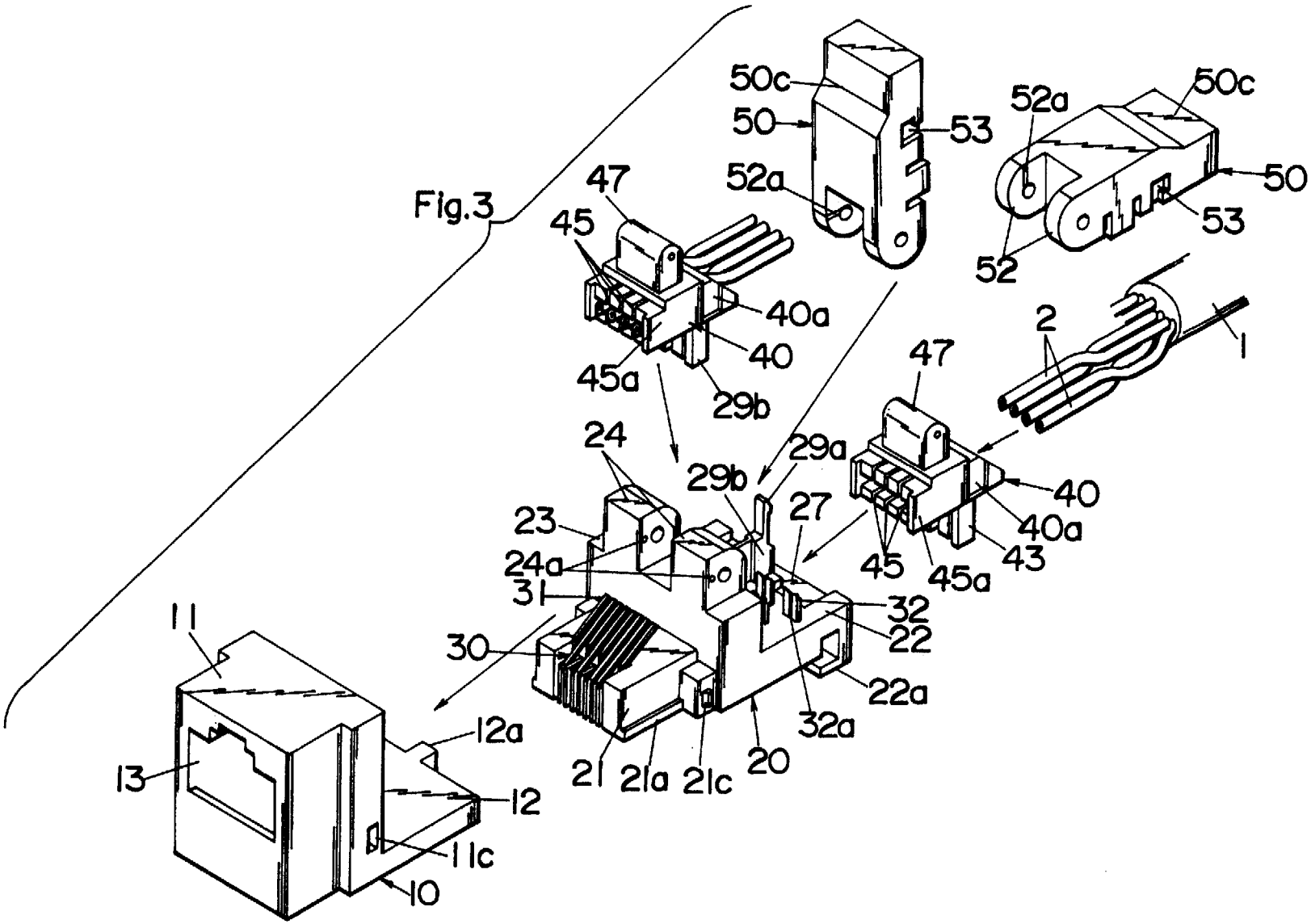
FIG. 3 illustrates an exploded front view of the first embodiment of the modular jack telephone connector.
Figure 4:
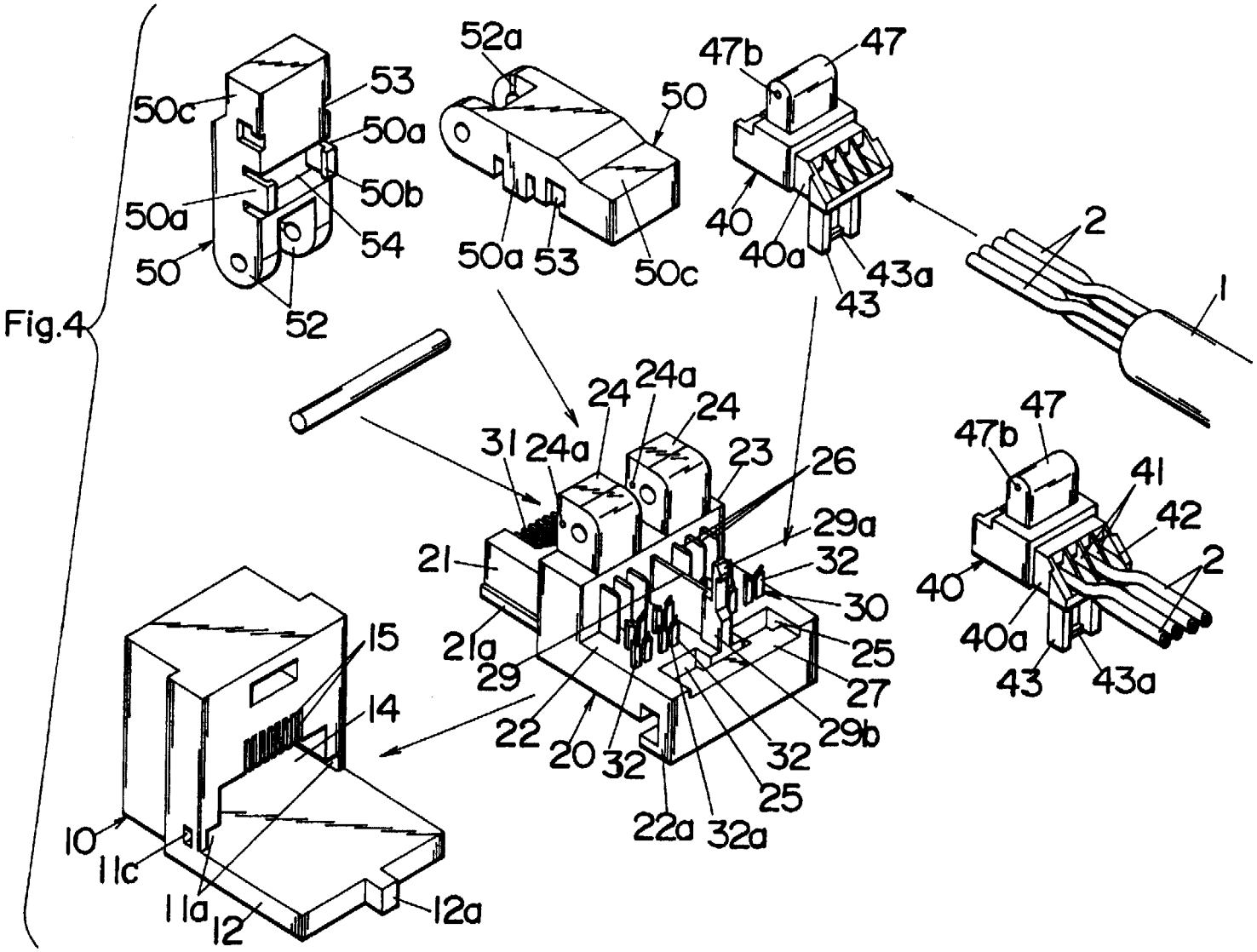
FIG. 4 illustrates an exploded back view of the first embodiment of the modular jack telephone connector.

FIGS. 3 and 4 illustrates components of the modular jack telephone connector 100, which are described in the followings.

The body 10 comprises a plug table 11 and a base 12 which extends from a lower portion of the plug table 11 toward the back of the connector 100. The plug table 11 comprises a plug opening 13 which is provided on a front surface of the plug table 11; a receptor opening 14 which extends from the opening 13 to a back of the plug table 11 and is located at the lower portion of the plug table 11; and slits 15 which are placed at the upper part of the receptor opening 14 and extends form the back of the plug table 11 to a front of the table 11. The openings 13 and 14 make one cavity in the body 10.

The carrier 20 has a contact table 21 at a front of the carrier 20; a terminal table 22 which is supported the terminals 32 vertically on a top surface of the terminal table 22, at a back of the carrier 20; and a wall 23 connecting the contact table 21 which extends from the wall 23 to the front and the terminal table 22 which extends from the wall 23 to the back in order to make one assembly. A jaw 22*a* projects from a back edge of the terminal table 22 and extends toward a bottom of the carrier 20. A bent 22*a* extends from the bottom to the front of the carrier 20. The carrier 20 is receivable within the body 10 through the receptor opening 14.

As to insertion the carrier 20 into the receptor opening 14 of the body 10, there are a catch 21*a* which is provided on each side of the contact table 21 and a groove 11*a* which is provided on each side of the reception opening 14 to receive the catches 21*a*. The carrier 20 is inserted into the reception opening 14 such that the catches 21*a* are sliding in and along the grooves 11*a*.

Once the carrier 20 is inserted into the body 10 completely, a back side of the plug table 11 abuts against a front side of the wall 23 in order that the carrier 20 is securely positioned with respect to the body 10.

A spike 12*a* projects the back edge of the base 12. A reception hole (not shown) is provided on the bent 22*a*. As the carrier 20 is inserted into the body 10 completely, the spike 12*a* is inset into the reception hole. At the inset condition, a latch 21*c* which is provided on each back side of the contact table 21 is fastened into a hole 11*c* which is provided on each back side of the plug table 11, for a purpose of secure insertion of the carrier 20 into the body 10. Thus, the terminal table 22 is mounted on the base 12 as the carrier 20 has been securely placed within the body 10.

A housing consists of the carrier 20 and the body 10. It is possible to manufacture a housing which a carrier 20 and a body 10 are integrally made.

Eight metal conductors 30 are used for the modular jack telephone connector 100. Each metal conductor 30 has a contact 31 at one end and a terminal 32 at the other end. The terminals 32 are projected vertically from the terminal table 22, and the contacts 31 are projected from the contact table 21 and extends toward the wall 23. A linker 33 is connected to a terminal 32 and a contact 31 under the carrier 20. As the carrier 20 is inserted into the body 10 through the reception opening 14, the contacts 31 are introduced into the slits 15 in order to separate the contacts 31 from adjacent ones. As a modular plug is inserted into the plug opening 13, each pin of the plug pushes a corresponding contact 31 toward a back of the contact table 21 for engaging electrical connection.

The modular jack telephone connector 100 connects a total of eight electric wires 2 to the eight metal conductors 30. Four of the electrical wires 2 are inserted to one fixture 40, and the other four of the wires 2 are inserted into the other fixture 40. Two sets of terminals 32 are mounted on the terminal table 22. As mentioned before, a terminal 32 has a pair of slicers 32*b*, thin and sharper metal pieces, as shown in FIG. 10 and a terminal slit 32*a*. An insulator cover is removed by the slicers 32*b*, as the electrical wire 2 is inserted into the terminal 32. A core 2*a* (not shown) of the electrical wire 2 is press-fitted in the terminal slit 32*a*. A width of the slit 32*a* is designed so that the core 2*a* contacts with the slit 32*a* for the press-fit.

A fixture 40 has four wire openings 42 partitioned by three separators 41 at a back of the fixture 40. Four electric wires 2 are inserted through the wire opening 42 from the back of the fixture 40. At a front of the fixture 40, vertical grooves 45 are provided equally spaced. And a gill 45*a* is provided on each side of the fixture 40 such that the gills 45*a* abuts against the wall 23 to bound the forward movement of the fixture 40.

The other fixture 40 is made symmetrically with respect to the fixture 40 mentioned previously.

Two sets of three vertical fins 26 are mounted on the terminal table 22 by a lower portion of the back side of the wall 23. Each set of the vertical fins 26 is mounted vertically and equally spaced each other with respect to the top surface of the terminal table 22. Each guide fin 26 is inserted into each of the vertical grooves 45. A set of the vertical fins 26 and a set of the vertical grooves 45 are used to secure a fixture 40 laterally and longitudinally with respect to the top surface of the terminal table 22.

It is possible to provide vertical grooves 45 on a carrier 20 and vertical fins 26 on a fixture 40.

A leg 43 of a fixture 40 extends from downwardly from a body of the fixture 40 and is inserted into a slide hole 25. A fixture 40 is secured laterally and longitudinally with respect to the top surface of the terminal table 22.

A head 47 is projected upwardly from the fixture 40. A top of the head 47 is rounded from the front to the back of the fixture 40. A projector 47*b* is provided on each side of the head 47. The shape of the head 47 is not limited to the rounded shape.

A vertical groove 40*a* is provided on each side of a fixture 40. A portion 29 comprises a hook 29*a*, vertical tenons 29*b* which are provided under and on opposite sides of the hook 29*a*, a separator extending from the hook 29*a* to the wall 23. The vertical groove 40*a*, facing the hook 29*a*, slides against the vertical tenons 29*b* as a fixture 40 slides upward and downward in the slide hole 25.

Each lever 50 has two arms 52. Each arm 52 has an axle hole on its lower side and a lever hole 52*a* which extends from the axle hole to a top surface of the lever 50. These arm 52 are fitted to corresponding receivers 24 on the carrier 20 having an axle hole so that all of the axle holes of the arms 52 and the receivers 24 are connected. An axle 51 is inserted through the connected axle holes.

Figure 5A:
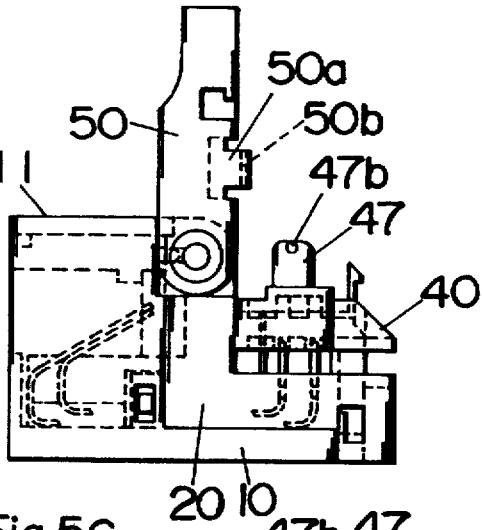
FIGS. 5A trough 5F illustrate side views of the first embodiment of the modular jack telephone connector in the present invention with various lever angles.
Figure 5B:
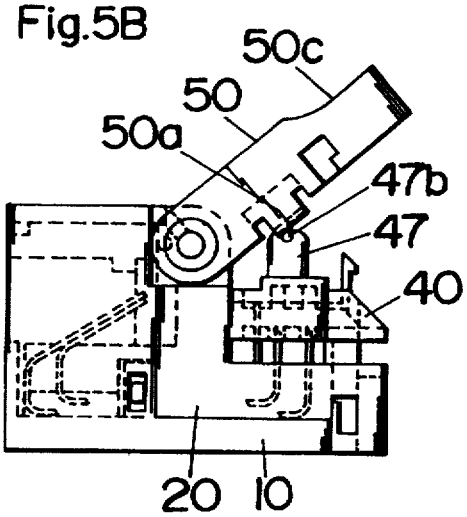
Figure 5C:
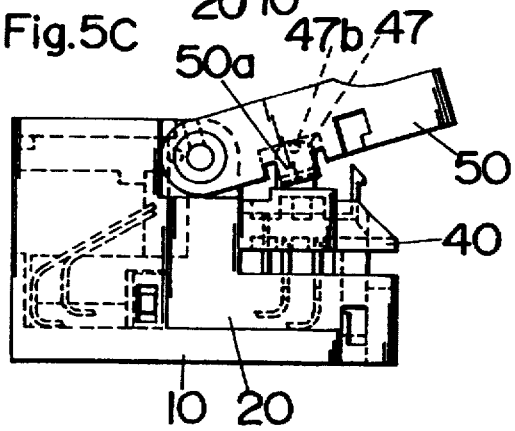
Figure 5D:
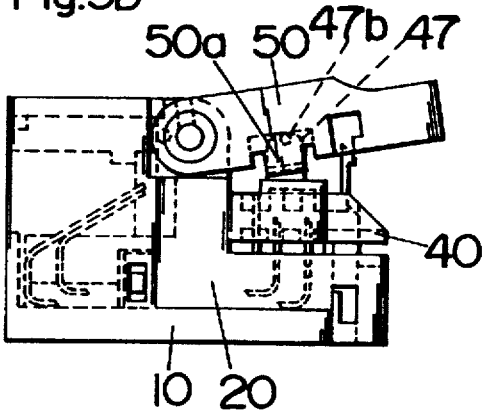
Figure 5E:
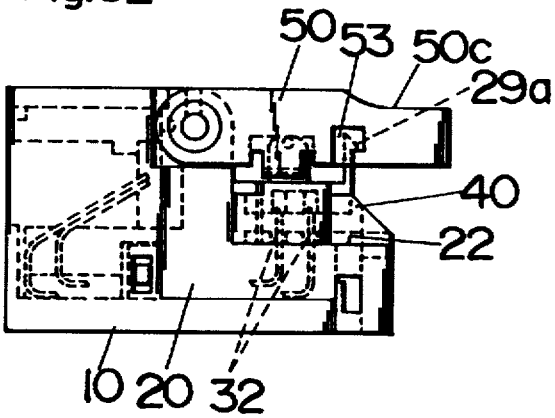

The lever 50 pivots about the axle 51 between an open (first) position configured such that the lever 50 is perpendicular to the terminal table 22 as shown in FIG. 5A and a close (second) position configured such that the lever 50 faces the terminal table 22 and making electrical contacts between the wires 2 which are inserted in the fixture 40 and the terminals 32 as shown in FIG. 5E. At the open position, a projector 24*a* on each front side of the receivers 24 is inserted into each of the lever holes 52*a* of the arms 52. A rotational angle of the levers 50 is approximately 90 degrees.

FIGS. 5A through 5C illustrate a interlock engagement (snapping-in connection) between a hook 50*b* which is provided on each latch 50*a* of the lever 50, and a projectors 47*a* which is provided on each side of the head 47. (These are side views of the modular jack telephone connector 100, and electric wires 2 are not shown.) For this engagement, the lever 50 rotates toward the fixture 40, a positive direction, from the open position shown in FIG. 5A to an intermediate position shown in FIG. 5C.

Concerning an contact mechanism to connect electrically a plurality of electric wires 2 to the terminals 32, the fixture 40 moves vertically and downward by pressing down the head 47 which is inserted into a lever gutter 54 which is provided between the latches 50*a* as shown in FIG. 3. In FIG. 5E, the lever 50 is secured with the hook 29*a* via a vertical groove 53 provided on a side of the arm 52. In this position equivalent to the close position, the fixture 40 approaches closest to the terminal table 22 for insulation displacement contacts.

Figure 5F:
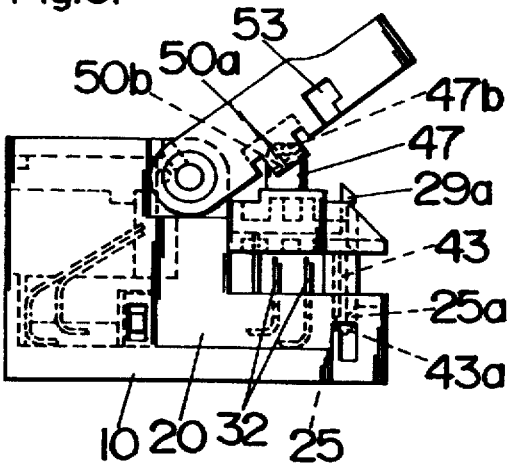

Conserving a release mechanism, which is a reverse of the engagement mechanism, the lever 50 rotates in the negative direction from the close position by lifting a bottom of the lever 50 as shown in FIG. 5F. Consequently, the fixture 40 moves upward and vertically by which the latches 50*a* pull up the projectors 47*b* of the head 47 via the hooks 50*b* while the terminals 32 are separated from the fixture 40.

The lever 50 can be disengaged from the head 47 by rotating further the lever 50 in the negative direction so that the hooks 50*b* are detached against the projectors 47*b*.

Figure 6:
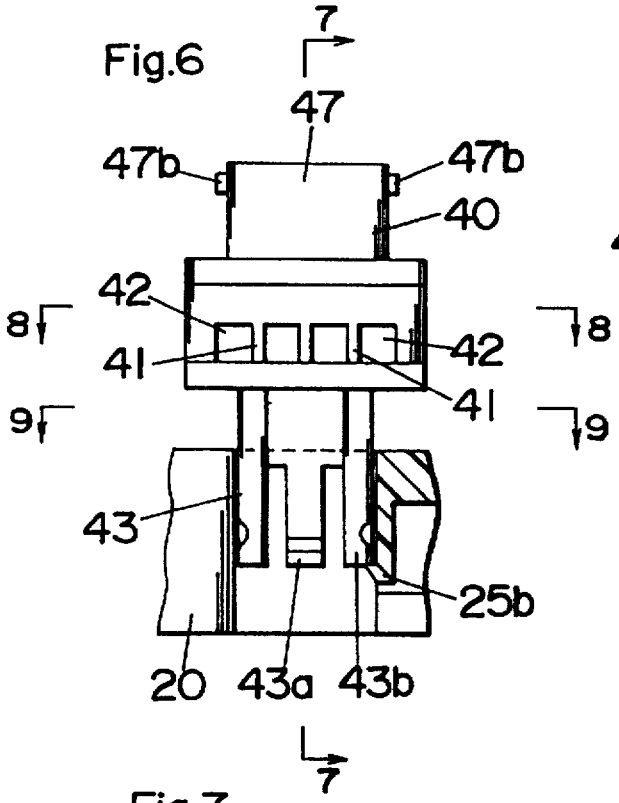
FIG. 6 illustrates a front view of a fixture of the first embodiment supported within a slid hole of a contact carrier.

As shown in FIG. 6, a fixture 40 is supported in the slide hole 25. A leg 43 of the fixture 40 has a middle branch and two side branches. The fixture 40 has a latch 43*a* which projects from a lower part of the middle branch of the leg 43 toward a back of the middle branch and two other latches 43*b* which are provided on the side branches of the leg 43. One of the latches 43*b* rests on a ledge 25*b* while the leg 43 is inserted into the slide hole 25.

Figure 7:
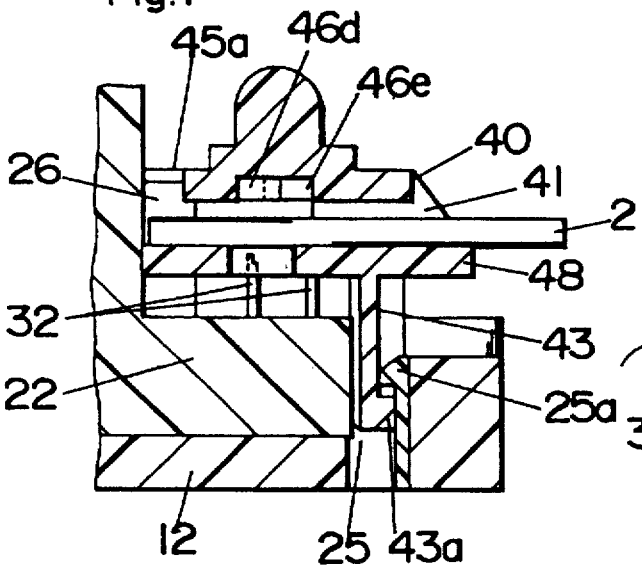
FIG. 7 illustrates a sectional view taken along line 7—7 of FIG. 6.

As shown in FIG. 7, the latch 43*a* is fastened with respect to the ledge 25*a* while the fixture 40 moves further downward. With the gill 45*a*, the latch 43*a* secures effectively the fixture 40 in its lateral and longitudinal directions. In this position, the wires 2 are not connected yet to the terminal 32.

Figure 8:
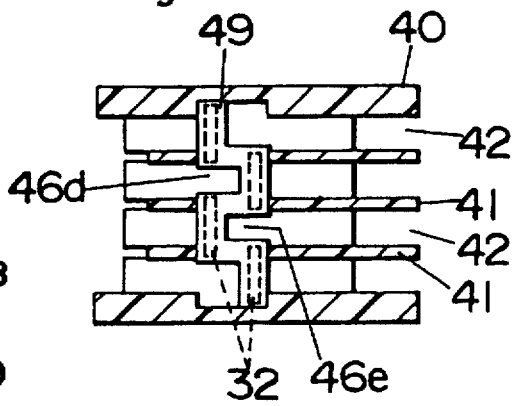
FIG. 8 illustrates a sectional view taken along line 8—8 of FIG. 6.

In FIG. 8, a terminal slot 49 extends laterally on a bottom of the top surface of a fixture 40. A shape of the terminal slot 49 is step wise or zigzagged. When the lever 50 is pressed to the position as shown in FIG. 7, four of the terminals 32 are inserted partially into the fixture 40 through another terminal slot 49 which is provided on a bottom surface 48 of the fixture 40. Two terminals 32 out of the four terminals 32 are staggered with respect to the two terminals 32. After the completion of electrical connection, the slicers 32*b* reach the terminal slot 49 on the top surface of the fixture 40.

Two sets of the terminals 32 are provided on the top surface of the terminal table 22. One set of the terminals 32 is placed closer to the wall 23 than the other set. The sets are positioned in parallel but staggered each other.

A fixture 40 having four wires 2 connect electrically to first two terminals 32 of each of the sets of the terminals 32, and the other fixture 40 having the other four terminals 32 connect electrically to the last two terminals 32 of each of the sets of the terminals 32.

The insulation displacement contacts between the wires 2 and the terminals 22 follow the following steps: (1) according to the downward movement of the lever 50, each electric wire 2 is pushed down by each pair of the pressers 46*d* and 46*e*; (2) each wire 2 makes a physical contact with each pair of the slicers 32*b*; (3) each pair of the slicers 32*b* cuts an insulation cover of each wire 2; (4) each of the terminals 32 makes an electrical contact with a core 2*a* of each wire 2 in a terminal slit 32*a*.

Figure 9:
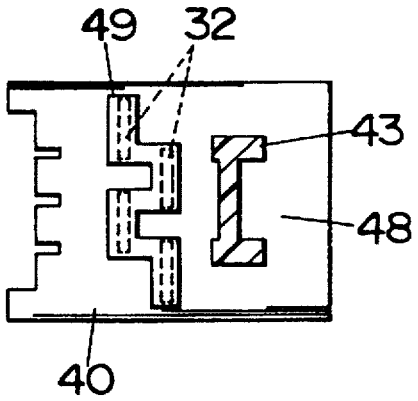
FIG. 9 illustrates a sectional view taken along line 9—9 of FIG. 6.

FIG. 9 illustrates a bottom view of the fixture 40. The zigzagged terminal slot 49 extends laterally on a bottom surface 48 of the fixture 40. The leg 43 extends outwardly from the bottom surface 48. A cross section of the leg 43 is shaped like a letter "H". A width of the slide holes 25 is approximately the same as that of the cross section of the leg 43. The terminal table 22 of the carrier 20 has a pair of slide hole 25 to receive the legs 43 on its top surface. The shapes of the leg 43 and the slide hole 25 are not restricted to the letter "H".

Figure 11A:
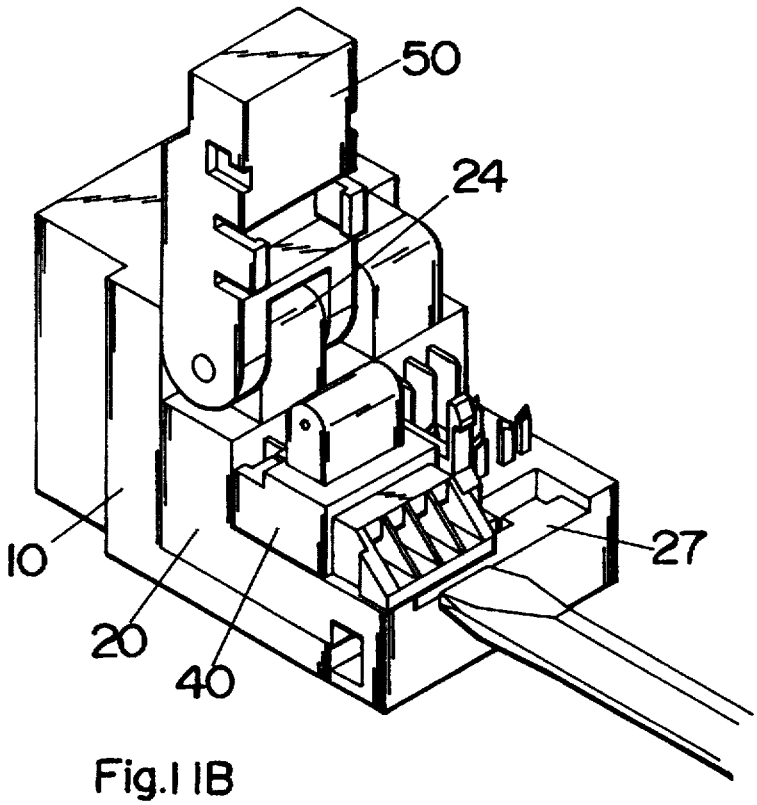
FIGS. 11A and 11B illustrate a detachment of electrical wires from metal conductor.
Figure 11B:
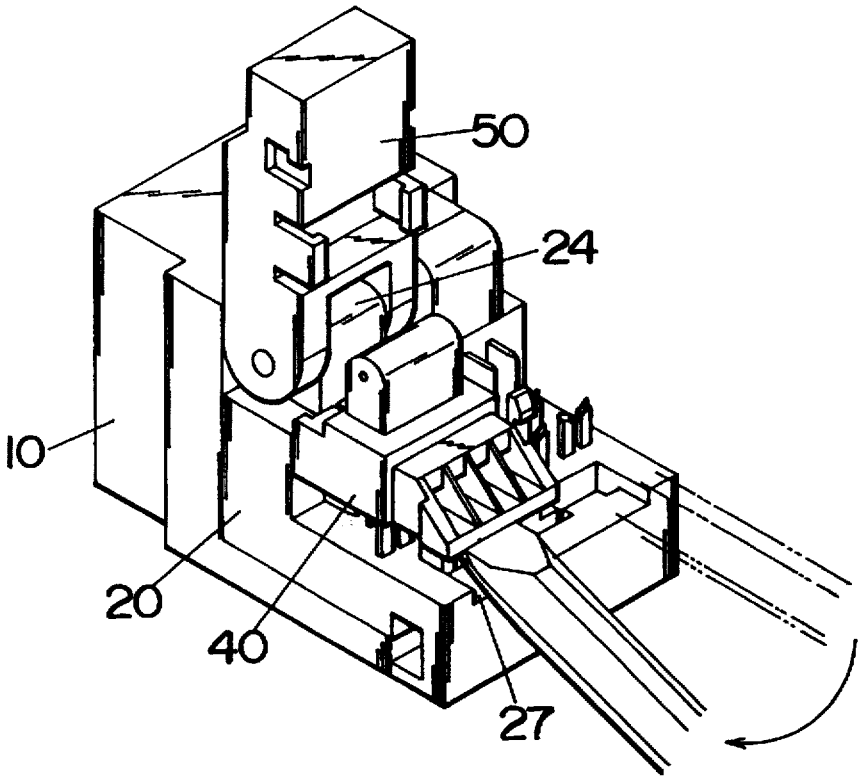

FIG. 11A and 11B, a recess 27, having its back side open, is provided at the back of the carrier 20 and on the top surface of the terminal table 22. The recess 27 is made by providing a notch at the back of the table 22. By using a tip of a screwdriver as a lever at the recess 27, the latch 43*a* and latch 43*b* are released so as to allow a fixture 40 to be lifted up with respect to the carrier 20. The recess 27 may be provided on the fixture 40.

If a force exerting on the wires 2 is greater than a lifting force of the lever 50 coupled with the fixture 40, the fixture 40 is stuck on the carrier 20. In this condition, if the lever 50 is rotated further in the negative direction, then the interlock engagement between the lever 50 and the fixture 40 is disengaged. In this case, the wires 2 are separated from the terminals 32 by using the detachment of the fixture 40 via the recess 27 described above.

Figure 12:
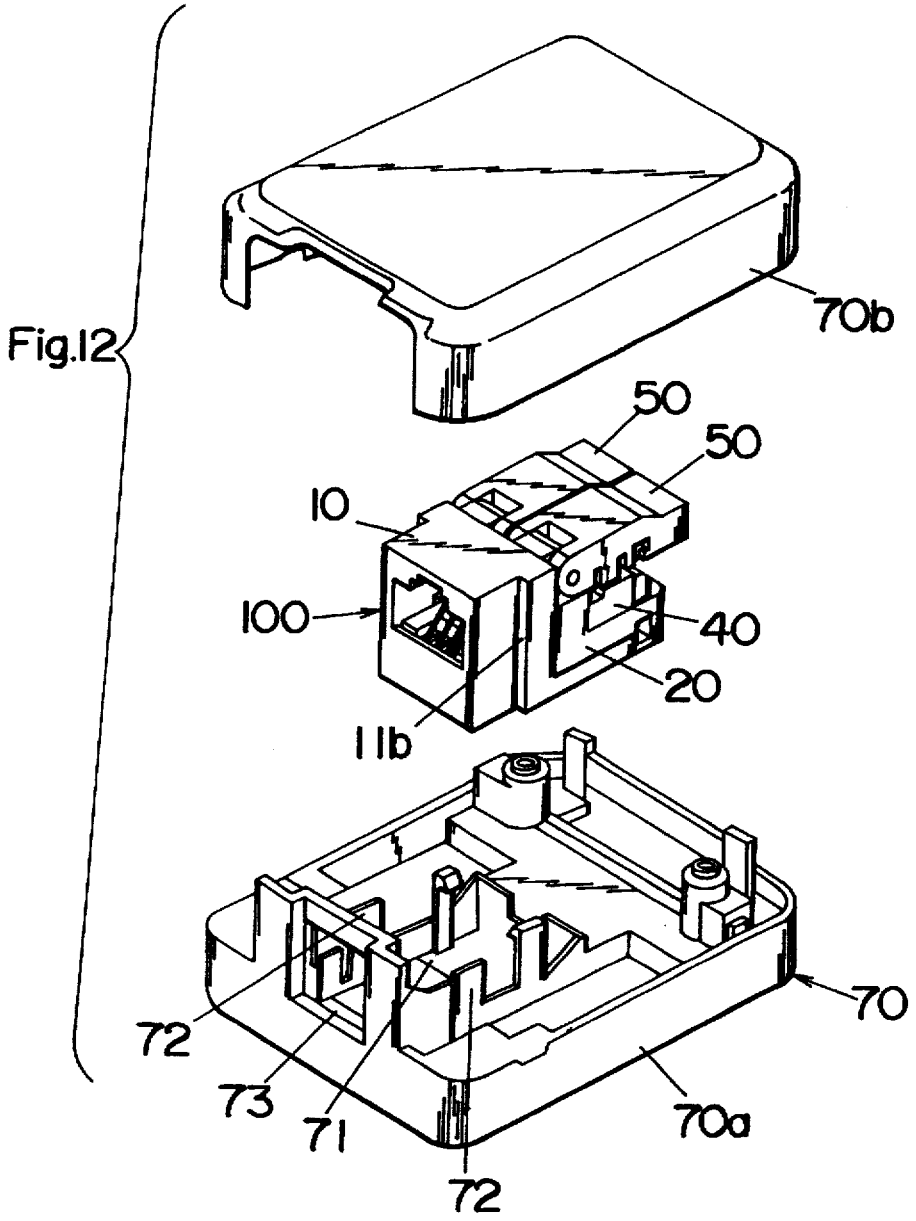
FIG. 12 illustrates an exploded view of the modular jack telephone connector incased between a cover and a holder.

In FIG. 12, the body 10 has a step 11*b* on each side of the connector 11 in order that the connector 100 is placed between side walls 72 of a holder 70*a*. A plug is inserted through a mouth 73. A cover 70*b* is covered on the holder 70*a* to incase the modular jack telephone connector 100 in a case 70.

(EMBODIMENT 2)

Figure 13:
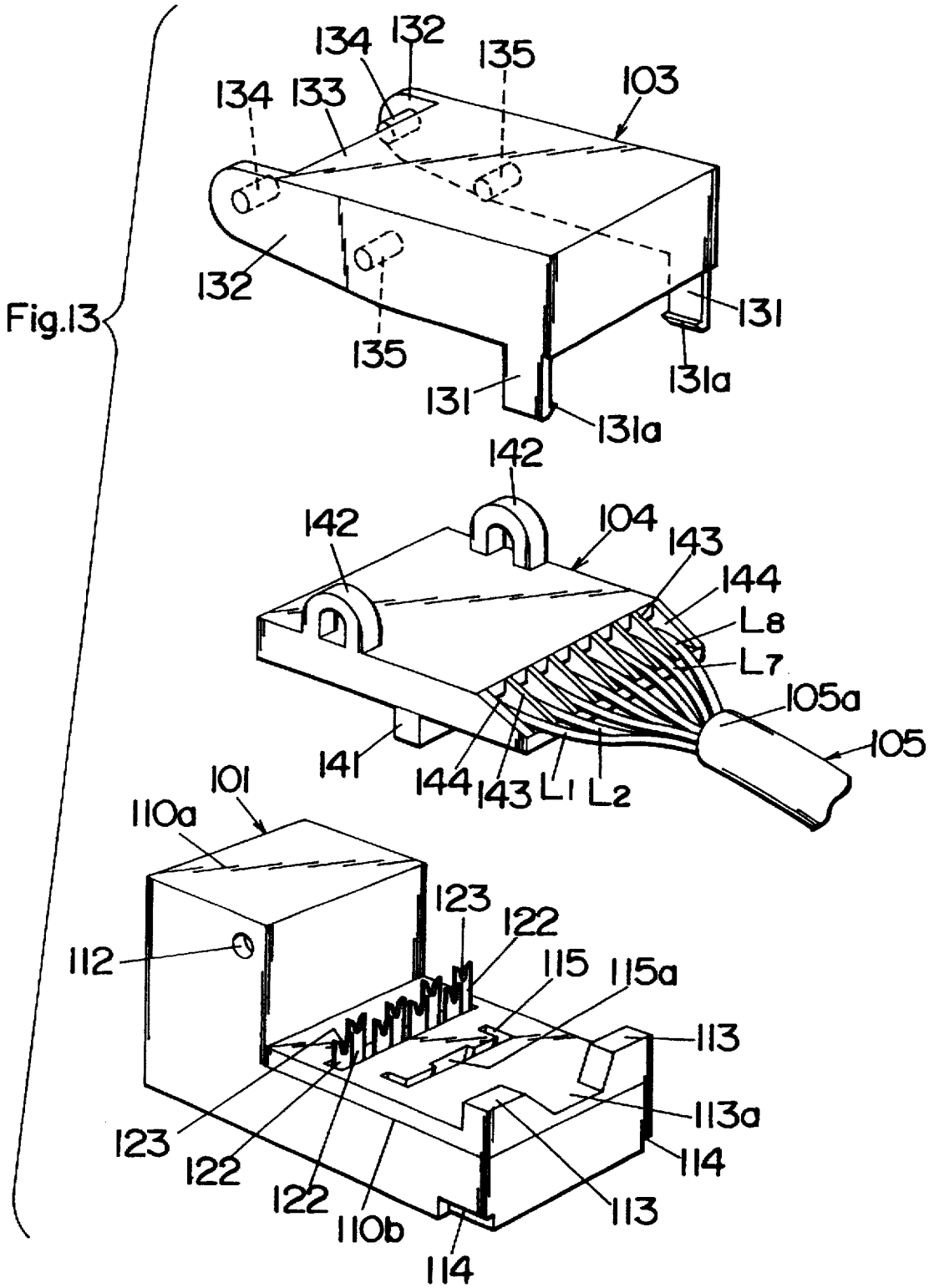
FIG. 13 illustrates an exploded view of a modular jack telephone connector in a second embodiment.

FIG. 13 illustrates a modular jack telephone connector in the second embodiment comprising a housing 101, a fixture 104, and a lever 103.

The housing 101 is made from a synthetic resin and consists of a plug table 110*a* and a terminal table 110*b* which extends from the plug table 110*a* toward a back of the connector in this embodiment. The direction of the extension of the terminal table 110*b* is defined as a back direction. The terminal table 110*b* has eight terminals 122 which are supported vertically on the terminal table 110*b*.

On the terminal table 110*b*, eight contacts 121 (not shown) are mounted inside of a plug mouth 111 (not shown) which receives an electrical plug (not shown). The contact 121 extend from a bottom of the mouth 111 toward a back of the mouth 111. A middle part of a contact 121 is bent, and a top portion of the contact 121 is flexible toward the bottom of the mouth 111. Each contact 121 is separated with a certain space in order to avoid electrical shorts and corresponds each pin of the plug when the plug is inserted into the mouth 11. Each contact 121 is connected by a linker 120 (not shown) which is provided inside of the housing, with each corresponding terminal 122.

On each of a top and back portion of the plug table 110*a*, a lever hole 112 is provided. A pair of projectors 113 are provided on a top and back surface of the terminal table 110*b*. A cable hole 113*a* is provided between the projectors 113. A groove 114 is provided on each side of a bottom and side portion of the terminal table 110*b* to receive a hook 131 which is provided on each lower side of the lever 103.

On a front part of the top surface of the terminal table 110*b*, two sets of terminals 122 are supported vertically. Each set has four terminals 122. Each terminal 122 has a pair of prongs 123 which are provided at the top portion of the terminal 122 in order to cut a cover of electrical wire 105*a* and clamp a core of the wire 105*a* for electrical connection.

Now referring to a stricture of the terminals 122. For example, as shown in FIG. 13, two sets of the terminals 32 are aligned parallel but staggered each other. A first set of the terminals 32 is one closer to the plug table 110*a*, and a second set of the terminals 32 is one farther to the table 110*a*. A first terminal 32 of the first set faces empty space posterior to a first terminal 32 of the second set. A second terminal 32 of the first set faces another empty space between the first and a second terminals 32 of the second set.

Now referring to an order of the wires 105*a* with the structure of the terminals 32 described above. For example, an electrical wire L8, a most outer wire of eight wires 105*a* (most posteriorly shown in FIG. 13), is inserted between prongs 123 of the first terminal 32 of the first set. An electrical wire L7, the next outer one of the wire L8, is inserted between prongs 123 of the second terminal 32 of the second set. Similarly, a most inner wire L1 (most frontally shown in FIG. 13) is inserted between prongs 123 of the most inner terminal 32 of the second set. A second inner wire L2, the next inner one of the wire L1, is inserted between prongs 123 of the most inner terminal 32 of the first set.

Between the projectors 113 and the terminals 122 and on the top surface of the terminal table 110*b*, a slide hole 115 is used to secure the fixture 104. A leg 141 of the fixture 104 is inserted into the slide hole 115 for the electrical connections between the terminals 122 and the wires 105*a*.

The lever 103 is made from a synthetic resin and has a lever pivot 134 which is provided on each front inner surface of side plates 132 of the lever 103. Each lever pivot 134 is inserted into a corresponding lever hole 112. The lever 103 rotates at the pivot 134 between a certain position of which the lever 103 faces the terminal table 110*b* to make electrical connection and a certain position of which the lever 103 is opened to separate the wires 105*a* from the terminals 122.

The lever 103 comprises the two side plates 132, a back plate, and a lid plate 133 and has a front side open. The side plates 132 are connected with the back plate under the lid plate 133. An interior of the side plates 132 and the back plate surrounds the projectors 113 and the terminals 32 on the terminal table 110*b* when the lever 103 is closed.

A hook 131 is provided on each of opposing lower and back sides of the lever 103. At an end of the hook 131, a nail 131*a* is provided in order that the nail 131*a* latches in a groove 114. Thus, the lever 103 is secured with the hooks 131 and the grooves 114 via the nails 131*a*.

The fixture 104 is made from a synthetic resin and depends from the lever 103 by which each lever pin 135 is inserted into corresponding hangers 142. Each lever pin 135 is provided on a middle portion of each of the side plates 132. The fixture 104 has a fixture body and a leg 141. A back end of the fixture body is opened for insertion of the wires 105*a*, and a front end of the fixture body is closed. A direction from the back end to the front end is the longitudinal direction of the fixture body and a direction perpendicular to the longitudinal direction is the lateral direction of the fixture body.

At a bottom surface of the fixture body, a cavity 145 (not shown) is provided through which the terminals 122 are inserted for electrical contacts with the wires 105*a* inside of the fixture body. A shape of the cavity 145 is rectangular. A longitudinal direction of the cavity 145 corresponds to the lateral direction of the fixture body.

Seven separators 143 extend from the back end to an back edge of the cavity 145 in order to divide a back portion of the fixture body to provide portions of eight wire holes 144. Also provided at the closed side of the fixture 104 are additional separators (not seen) for separately the distal ends of the wires L1–L8. Each electrical wire is inserted from a corresponding back portion of a wire hole 144, across the cavity 145, reaches a corresponding front portion of the hole 144; and an end of the wire touches the front end of the fixture body.

At a top surface of the fixture body and above the cavity 145, gutters 146 (not shown) extend laterally with respect to the fixture body. When the lever 103 is closed for electrical connection, the fixture 104 moves downward; the terminals 122 are inserted into the fixture body through the cavity 145; peripherals of the gutters 146 push parts of the wires, which are located above the cavity 145, downward; each of the parts of the wires is inserted between each pair of prongs 123 of the wires for electrical connection. Tips of the terminals 32 reach to the gutter 146 at the closed position.

The fixture 104 has a leg 141 which is inserted into a slide hole 115 which is provided on the terminal table 110*b*. The leg 141 has a pair of side guides 141*a* (not shown) and a center guide 141*b* (not shown) which is provided between the side guides 141*a*. A cross section of each of the side guides 141*a* is like a "L" shape. These guides 141*a*, 141*b* are provided as separate parts. The center guide 141*b* has a nail 141*c* at a free end of the center guide 141*b*. The nail 141*c* (not shown) is used to latch a stopper which is provided in the slide hole 115. At a center of the slide hole 115, the slide hole 115 becomes wider to receive the center guide 141*b*. Ends of the slide hole 115 extend toward the front of the terminal table 110*b* so that the slide hole 115 fits to the side guides 141*a*.

For an engagement mechanism, first of all, the lover 103 is lifted to provide enough space for insertion of the cable 105. The cable 105 is moved toward the fixture 104 so that electrical wires 105*a* are inserted into the wire holes 144. As a result, the cable 105 is mounted within space 113*a* on the top surface of the terminal table 110*b*. Once each of the wires 105*a* is inserted into each of corresponding wire holes 144 nicely, ends of the wires 105*a* abut against- the closed front side of the fixture box.

As the lever 103 is pressed downward and toward the terminal table 110*b* by hands, the fixture 104 moves toward the terminals 122 since the fixture 104 linked with the fixture 104 via the lover 103 via the lever pins 13 and the hangers 142. The wires 105*a* in the fixture 104 approach to the terminals 122 through the cavity 145 for electrical connection. After the lever 103 is completely closed, the cable 105 is fastened between the leer 103 and the terminal table 110*b*. The closed position of the lever 103 configures a position where the nail 141*c* is latched against the terminal table 110*b*.

For a release mechanism of the wires 105*a* from the terminals 122, the nails 131*a* are unlatched from the grooves 114 and the nails 141*c* is unlatched from the stopper provided inside of the slide hole 115 in the terminal table 110*b*. After completing these unlatch steps, the lever 103 is lifted up, resulting in simple detachment of all wires from the terminals 122.

Since the preferred embodiments of the present invention has been shown, it will be obvious to those skilled in the art that changes and modifications may be made without departing from the teachings of the present invention. It should be noted that the disclosed connector is modified to have a single lever and two fixtures or three levers and three fixtures with necessary numbers of tenons, vertical grooves, latches, slide holes, interlock structures, and heads. In addition, the terminals 32 may be arranged in a single row or in plurality of rows either in parallel alignment or in a non-parallel configuration. According to a structure of the terminals 32 chosen, a suitable shape of the terminal slot 49 can be selected.

What is claimed is:

1. A modular electrical connector for connection with an associated modular plug, said modular connector comprising:

a housing with a contact carrier which carries a plurality of metal conductors each having a contact portion for engagement with a corresponding lead of said modular plug and a terminal portion for wiring connection with a wire having an insulation covering;

a fixture mounted on said contact carrier for holding end portions of a plurality of said wires, said fixture being supported to be movable between an open first position where said wires are spaced away from said terminal portion and a second position where said wires come into engagement respectively with said terminal portions;

guide means provided to guide said fixture vertically between said first and second positions;

characterized in that:

a lever is pivotally supported to said housing for rotation about a pivot axis, said lever being operatively connected to said fixture so that a pivot motion of said lever about the pivot axis is translated into a vertical movement of said fixture from said first position to said second position.

2. The modular electrical connector as set forth in claim 1, wherein said guide means comprises at least one vertical fin which is formed in one of said fixture and said carrier for sliding engagement with a vertical groove formed in the other of said fixture and said contact carrier.

3. The modular electrical connector as set forth in claim 2, wherein said fixture has an opening through which the plurality of said wires are inserted and is provided at an entrance of said opening with first separators for separately introducing said wires into said opening, said contact carrier being formed with second separators projecting into said opening opposite of said entrance for separating the ends of said wires, and said second separators defining said vertical fins.

4. The modular electrical connector as set forth in claim 1, wherein said contact carrier is formed with a partition by which said carrier is divided into two sections each provided with said terminal portions and receiving each one of two said fixtures, said guide means comprises vertical tenons formed on opposite sides of said partition for sliding engagement with vertical grooves formed in side faces of said two fixtures, respectively.

5. The modular electrical connector as set forth in claim 1, wherein said lever is connected to said fixture by interlock means which permits said lever to be disengaged from said fixture after said lever pulls said fixture vertically upwardly beyond a release position spaced upwardly from said second position by a certain distance.

6. The modular electrical connector as set forth in claim 5, wherein latch means is provided to stop said fixture at said release position when said fixture is moved upwardly from said second position.

7. The modular electrical connector as set forth in claim 1, wherein said contact carrier includes a hook which comes into engagement with said lever when said lever pivots to a lock position of holding said fixture at said second position.

8. The modular electrical connector as set forth in claim 1, wherein retainer means is provided to retain said lever in a rest position where said lever is disengaged from said fixture.

9. The modular electrical connector as set forth in claim 8, wherein said retainer moans comprises a projection which is formed on said housing adjacent to said pivot axis to be able to engage with a hole formed in an end of the lever adjacent to said pivot axis.

10. The modular electrical connector as set forth in claim 1, wherein the plurality of said terminal portions project on said contact carrier and are arranged in two rows such that said terminal portions in one of the two rows are staggered with respect to those in the other row; and wherein said fixture has an opening through which the plurality of said wires are inserted;

said fixture having a bottom wall with a single zigzagged slot through which said terminal portions extend into said opening for engagement with said wires, respectively when said fixture is moved to said second position.

11. The modular electrical connector as set forth in claim 1, wherein said fixture has an opening through which the plurality of said wires are inserted and is provided at an entrance of said opening with first separators for separately introducing said wires into said opening, said contact carrier being formed with second separators projecting into said opening opposite of said entrance for separating the ends of said wires.

12. The modular electrical connector as set forth in claim 1, wherein one of said fixture and said housing is notched to form a recess in a mating surface between said housing and said fixture for receiving a jig adapted in use for disengaging said wires from said metal conductors.

13. The modular electrical connector as set forth in claim 1, wherein said fixture is formed with a head which comes into contact with said lever for receiving a downward force therefrom for moving said fixture from said first position to said second position.

* * * * *